US005083409A

United States Patent [19]

Pliml, Jr.

[11] Patent Number: 5,083,409

[45] Date of Patent: Jan. 28, 1992

[54] CASEMENT WINDOW FASTENING SYSTEM

[75] Inventor: Frank V. Pliml, Jr., Arlington Heights, Ill.

[73] Assignee: Illinois Tool Works Inc., Glenview, Ill.

[21] Appl. No.: 594,100

[22] Filed: Oct. 9, 1990

[51] Int. Cl.[5] ..... E04B 1/38

[52] U.S. Cl. ..... 52/718; 52/586; 403/297

[58] Field of Search ..... 52/586, 213, 214, 585, 52/357, 718; 403/292, 297, 397, 409.1

[56] References Cited

U.S. PATENT DOCUMENTS 2,243,322 5/1941 Van Uum ..... 52/718.1
2,708,779 5/1955 Tiger ..... 403/297
3,251,103 5/1966 Saut ..... 52/718.1
3,274,740 9/1966 Hall ..... 52/718.1

FOREIGN PATENT DOCUMENTS 659865 10/1951 United Kingdom ..... 52/718

*Primary Examiner*—David A. Scherbel
*Assistant Examiner*—Robert Canfield
*Attorney, Agent, or Firm*—Schwartz & Weinrieb

[57] ABSTRACT

A fastening arrangement for securing abutting components is particularly adaptable to secure contacting members of a window assembly, which arrangement utilizes a clip with deflectable arms positionable and securable within a first groove having an anchoring sidewall notch defined within one member of the window assembly and a second groove and notch defined within the abutting member for housing clip extending arms so as to secure the abutting member.

5 Claims, 1 Drawing Sheet

CASEMENT WINDOW FASTENING SYSTEM

FIELD OF THE INVENTION

The present invention relates to a fastening system for securing components with abuttable surfaces. More specifically, a resilient fastening clip is provided to anchor window assembly members such as, for example, molding strips, to a window assembly sash or frame, which clip has arms or panels which are deflectable so as to allow assembly and which are also resilient so as to recover to a reference position for securely coupling the frame, sash sill, or molding members. The clip arms are again deflectable so as to permit disassembly of the coupled elements for repair or replacement of either member.

BACKGROUND OF THE INVENTION

A window fastener utilizing a clip secured to a sash so as to engage serrations defined within the base of a window frame for permanently securing the frame in position within a wall section is noted in U.S. Pat. No. 2,840,202 to T. Hehr. The clip is securely anchored to the sash with an upturned clip end protruding toward the inner part of the window opening for engagement with the serrations defined within the bottom of the frame assembly. Similarly, U.S. Pat. No. 2,840,203 to E. T. Hehr illustrates a clip arrangement with the clip anchored to the window frame. A protruding tongue engages the sash so as to permanently secure the window within the window opening. The assemblies taught in these patents provide permanent anchoring of the frames and sashes within the window opening without consideration for their subsequent removal for repair and/or replacement. More particularly, it is noted that these fastening devices are specifically utilized for the installation of prefabricated window frames.

U-shaped fasteners are utilized for joining other assemblies and structures, such as, for example, the fastening device for the corners of wood structures disclosed in U.S. Pat. No. 1,537,678 to Jensen. The device utilizes a pair of U-shaped channels with extending feet at the web extremities, which webs each nest into a notch defined within mating legs or corners so as to maintain the corners in position. However, there is no apparent means for disengaging the coupled corners except to slide the mated components along their longitudinal axes so as to dislodge the fastening device. The corner retaining fasteners are implicitly utilized at an end of a component and are not intended to be deflected for installation or disassembly.

A fastener for securing two members in an edge-to-edge abutting relationship is disclosed in U.S. Pat. No. 2,863,185 to A. T. Riedi. Tapered or dove-tailed slots with substantially wider bases than mouths are provided within abutting structural members for receiving a fastener. The fastener in its reference shape is insertable within the aligned slots and is deformable so as to conform to the shape of the slot and thus anchor the two members together. It is particularly noted that the deformed fasteners permanently and rigidly connect the two members.

An elongated locking strip particularly utilized for the assembly of the legs of a table is shown in U.S. Pat. No. 4,290,371 to Snitzer et al., which provides an elongated U-shaped strip with tabs folded into the strip gap. The strip is insertable into juxtaposed channels of abutting faces of the table legs so as to maintain the legs in position. No provision is made for disassembly of the legs.

SUMMARY OF THE INVENTION

The present invention provides a groove and fastener clip arrangement with clip-deflectable and resilient arms for insertion into the juxtaposed grooves of abutting faces of window assembly components, such as, for example, a sash, window frame or molding so as to maintain the components in their assembled state. The clip arms are deflectable so as to allow disassembly of the mated components for maintenance, repair or replacement of either member without requiring drilling or other destructive processes to be performed upon either coupled member.

BRIEF DESCRIPTION OF THE DRAWINGS

Various other objects, features, and attendant advantages of the present invention will become better understood from the following detailed description, when considered in connection with the accompanying drawings, in which like reference numerals identify like components throughout the several views, and wherein.

DETAILED DESCRIPTION OF THE PREFERRED EMBODIMENT

Figure 1:
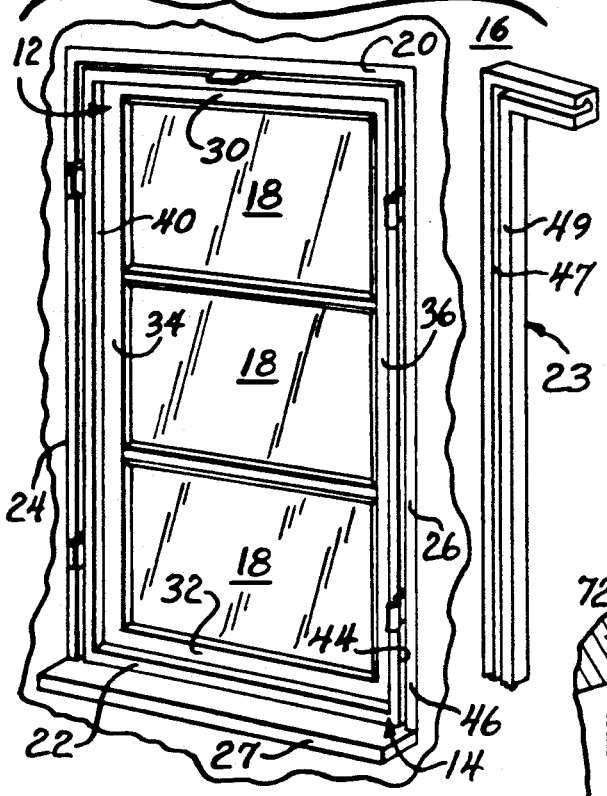
FIG. 1 is a perspective view of a frame and sash assembly with a decorative molding positioned for mounting.
Figure 4:
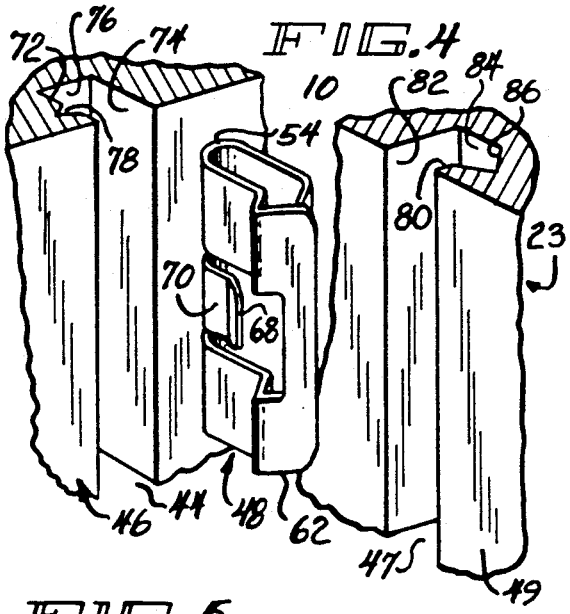
FIG. 4 is an exploded view in perspective of the clip of FIG. 3 with the grooves for the clip defined within both the sash and molding: and, FIG. 5 is a cross-sectional view of the frame and sash assembly in FIG. 1 showing the mated sash, molding and clip of the preferred embodiment.
Figure 2:
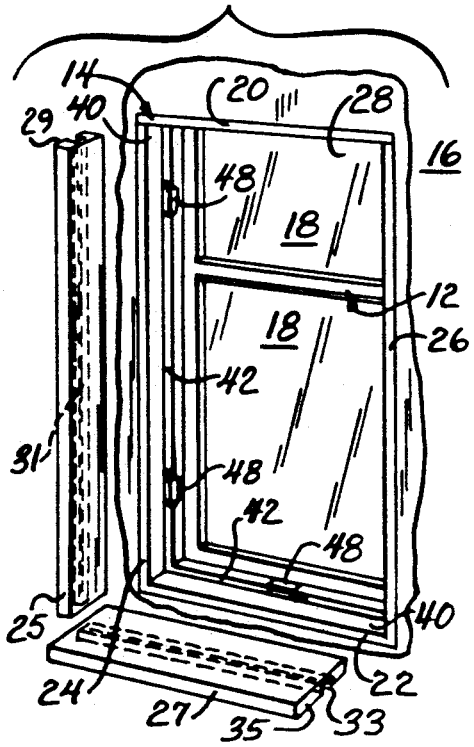
FIG. 2 is an exploded view of the window frame and sash assembly of FIG. 1 with an alternative mounting position for the decorative molding.
Figure 5:
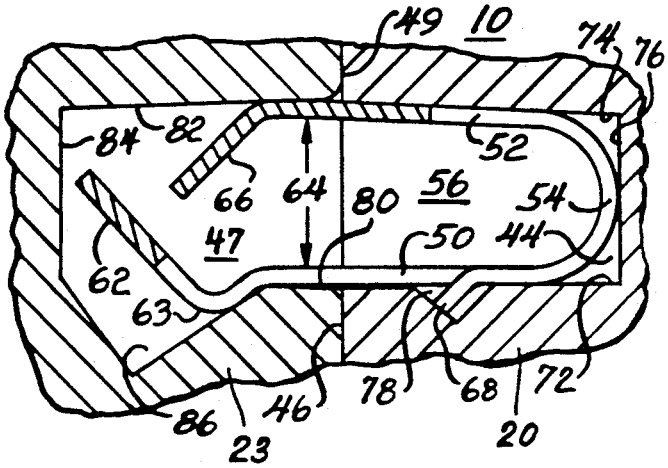

A fastening arrangement 10 for a window assembly 16, which may include a sash 12 and frame 14, is illustrated in FIGS. 4 and 5 in accordance with a preferred embodiment of the present invention. Assembly 16 is also illustrated in FIGS. 1 and 2 wherein sash 12 and frame 14 are disclosed, and wherein further, the frame 14 comprises top segment 20, lower segment 22 and side segments 24 and 26 connecting the top and lower segments 20 and 22. The several segments 20–26 outline window opening 28 for sash 12, which has window panels 18 disposed therein. The perimeter of sash 12 is similarly outlined by means of upper rail 30, lower rail 32 and side rails 34 and 36 connecting upper and lower rails 30 and 32 for mating within frame 14 and opening 28. In the assembly 16 of FIGS. 1 and 2, sash 12 has three window panels 18, however, this is merely exemplary and not a limitation.

The several segments 20–26 each have an inner frame surface 40, which abuts with an opposing surface of a juxtaposed sash element within window opening 28, which sash 12 is secured within frame 14 so as to provide a functional structural component. The frame 14 and sash 12 are frequently assembled with rough, unfinished exposed surfaces 40. A trim or molding piece may thereafter be mounted upon this surface so as to cover and enhance the appearance of the window assembly 16. In some assemblies 16, a groove and clip arrangement 10 disposed within the abutting surface may be utilized so as to secure these molding and frame elements together.

In FIG. 2, the fastening arrangement 10 has clips 48 positioned within a groove 44 defined within frame outer surface 46 as seen in FIG. 1. In this illustration, groove 44 is provided within each outer surface of segments 20, 24 and 26. Furthermore, a similar groove may be provided wherein lower segment 22 for sill 27. As the fastening arrangement 10 disposed within each segment 20-26 is similar, only one clip 48 and groove 44 will be described, but it will be understood that this description is equally applicable to the several segments and assemblies.

In an exemplary assembly, fastener arrangement 10 in FIG. 1 couples molding 23 with frame members 20 and 26. Molding 23 has a groove 47 defined within one face 49 thereof, which face 49 is abuttable against exposed outer surface 46 so as to provide a smooth joint or junction of frame 14 and molding 23. In the Figures, surfaces 46 are squared edges but the present invention is also applicable to beveled surfaces.

In the example of FIG. 1 molding 23 is anchorable upon and overlays frame surface 46 so as to provide a decorative trim to a window assembly 16. In this embodiment, frame 14 has at least one clip 48 disposed within groove 44 along segments 20, 24, 26. Molding surface 49 and frame surface 46 are abuttable so as to dispose grooves 47 and 44, respectively, in longitudinal alignment with respect to each other. Although grooves 44 and 47 are illustrated as extending the entire length of their respective surfaces it is contemplated that alignable and finite length grooves may also be provided within these faces so as to receive the clips 48.

Figure 3:
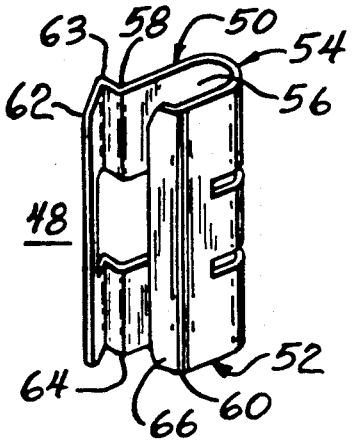
FIG. 3 is a perspective view of a resilient clip for securing mating components of the window assembly.

In the preferred embodiment, clip 48 for securing molding 23 upon frame 14 in the assembled condition is illustrated in FIG. 3. First clip arm or panel 50 and second clip arm or panel 52 extends from arcuate section 54, which arms 50 and 52 are generally parallel and have a gap 56 defined therebetween at the reference position of FIG. 3. A first flange 62 is positioned at first arm edge or end 58 and extends from arm 50 at an obtuse angle at open end 64 of U-shaped clip 48. Detent 63 for gripping a mating surface of the molding 23 is provided at the junction of first flange 62 and first arm edge 58 and protrudes outwardly from flange 62 and gap 56 at open end 64 of clip 48. Similarly, second flange 66 is coupled to and extends obtusely from second arm edge or end 60 beyond open end 64 and gap 56.

Resilient arms 50 and 52 are deflectable into gap 56 from the reference position of FIG. 3 for insertion of clip 48 into groove 44, wherein the arms are subsequently matable with groove 47 so as to securely retain molding 23 upon frame 14. Groove 44, as noted above, may extend along the length of surface 42 or be a fixed length groove along surface 46, but either arrangement has first sidewall 72, second sidewall 74 and base or end wall 76. First sidewall 72 in the Figures includes a notch 78 extending generally parallel with groove 44 and operable so as to receive a tongue 68 of clip 48 so as to mechanically retain clip 48 wherein groove 44.

In FIGS. 4 and 5, outwardly protruding tongue 68 of resilient flap 70 is stamped or formed within first arm 50 and extends from second arm 52 through arcuate section 54. Arms 50 and 52, as noted, are deflectable into gap 56 for insertion of arcuate section 54 within groove 44, wherein section 54 and clip 48 are secured within groove 44 by means of tongue 68 nesting within notch 78. Tongue 68 biases arm 50 inwardly with respect to gap 56 as a result of its contact with first sidewall 72 and biases second arm 52 outwardly, whereby a compressive force and frictional engagement between second arm 52 and sidewall 74 and through means of arcuate section 54 is developed.

Molding groove 47 defined within surface 49 similarly includes generally parallel first and second sidewalls 80 and 82 and second base or end wall 84. Clip flanges 62 and 66 provide smooth sloped surfaces for mating engagement of the pressed-on element 23 upon the insertion of clip 48 into groove 47, and longitudinal slot 86 defined within first sidewall 80 receives detent 63 for retention of clip 48 within groove 47. Flap 70 anchored within notch 78 biases second arm 52 outwardly, which acts through means of arcuate section 54 so as to bias first arm 50 outwardly with respect to gap 56. Thus, clip arm 50 is maintained against first sidewalls 72 and 80 and detent 63 is biased into longitudinal slot 86 so as to secure molding 23 upon clip 48. Molding 23 and frame 14 are consequently maintained in juxtaposed position with abutting faces 49 and 46 securely retained in their preferred orientation by means of the mating engagement of clip 48 within grooves 44 and 47. Disassembly of molding 23 from frame 14 is easily accomplished by means of the insertion of a knife edge between faces 46 and 49 so as to deflect at least one of the arms 50 and 52, which allows disengagement of the coupled members 23, 14 for repair or replacement.

An alternative placement of fastener arrangement 10 is shown in FIG. 2 with frame 14 having inner exposed surfaces 40 along each segment 20-26, wherein each surface 40 has longitudinal groove 42 defined therein. Molding 25 is positionable within window opening 28 so as to be mounted upon frame surface 40 as a decorative trim or molding piece. Molding rear face 29 has a longitudinal molding groove 31 that is alignable with inner surface groove 42 of frame 14 for anchoring the same upon frame 14 by means of at least one clip 48 mounted within inner surface groove 42. The cross-section of inner surface groove 42 is similar to outer surface groove 44, which was described above and molding groove 29 is similar in cross-section to first molding groove 47.

Inner molding 25 is securable to inner face 40 of frame segment 24 by at least one clip 48 mating with grooves 42 and 31. Similar clip and groove arrangements are provided upon frame segments 20 and 26 so as to secure molding pieces upon their respective inner surfaces 40. Window sill 27 has a groove 33 defined within the lower face 35 thereof, which groove 33 is alignable with longitudinal groove 42 defined within frame lower segment 22 for mating with at least one clip 48 so as to anchor sill 27 upon segment 22.

Although the above description particularly referred to moldings 23 and 25 with frame segments 26 and 24, it is considered that similar coupling of other abuttable elements, such as, for example, sill 27 with either one of frame 14 or sash 12, is accommodatable by means of fastener arrangement 10.

While only a particular embodiment of the invention has been described and claimed herein, it is apparent that various modifications and alterations of the invention may be made. It is therefore the intention of the appended claims to cover all such modifications and alterations as may fall within the true scope and spirit of the invention.

What is claimed is:

1. A fastening arrangement for coupling a first window component having a first surface, and a second component having a window panel mounted therein and having a second surface, comprising:

a spring clip having a first arm, a second arm, and an arcuate section coupling said first and second arms together;

said first arm having a first end, and said second arm having a second end, each of said ends being disposed opposite said arcuate section, and said arms cooperating so as to define a gap therebetween which has an opening disposed opposite said arcuate section at said arm ends;

a first elongate groove defined by and within said first surface of said first window component;

a second elongate groove defined within said second surface of said second component, said first and second grooves being alignable upon juxtaposition of said first and second component surfaces;

said spring clip arms being resiliently deflectable with respect to each other for permitting insertion of said arcuate section within one of said aligned first and second grooves defined within said first and second surfaces of said first and second components; and said first and second ends of said arms extend into the other one of said aligned first and second grooves defined within said first and second surfaces of said first and second components so as to secure said first and second components together upon abutment of said first and second surfaces.

2. A fastening arrangement as claimed in claim 1, further comprising:

a resilient flap defined within one of said first and second clip arms, which flap has a tongue protruding outwardly from said gap and arm;

one of said first and second grooves having a first longitudinal axis with a first sidewall and a second sidewall; and a notch defined within one of said first and second sidewalls, said tongue being deflectable upon clip insertion into said one of said first and second grooves and being flexurally recoverable so as to engage said notch so as to secure said clip within said one of said first and second grooves.

3. A fastening arrangement as claimed in claim 2, further comprising:

a detention at the end of said one arm, which detent is convex with respect to said clip gap and said opening;

the other one of said first and second grooves having a third sidewall and a fourth sidewall, one of said third and fourth sidewalls being generally aligned with said one of said first and second sidewalls, wherein one of said third and fourth sidewalls defines a slot, and said detent is engageable with said slot so as to secure said clip within said other one of said first and second grooves upon insertion of said clip so as to secure said first and second components together.

4. A fastening arrangement as claimed in claim 1, wherein:

one of said first and second components is a window sash having a plurality of side rails outlining its perimeter; and the other one of said first and second components is at least one decorative molding which is abuttable with and securable to one of said sash rails by said fastening arrangement.

5. A fastening arrangement as claimed in claim 1, wherein:

one of said first and second components is a window frame having a plurality of segments; and a plurality of other one of said second components are provided for each one of said frame segments, wherein said second components and said frame segments are abuttable and securable by said fastening arrangement.

* * * * *